US011813621B2

(12) United States Patent
Shen et al.

(10) Patent No.: US 11,813,621 B2
(45) Date of Patent: Nov. 14, 2023

(54) SWITCHING DEVICE FOR SHOWER SYSTEM AND SHOWER SYSTEM INCLUDING SAME

(71) Applicant: XIAMEN DELMEI SANITARY WARE CO., LTD., Xiamen (CN)

(72) Inventors: Jianxiong Shen, Putian (CN); Biao Shen, Xiamen (CN); Changzheng Ni, Xiamen (CN); Wenjun Li, Nanping (CN)

(73) Assignee: XIAMEN DELMEI SANITARY WARE CO., LTD., Xiamen (CN)

( * ) Notice: Subject to any disclaimer, the term of this patent is extended or adjusted under 35 U.S.C. 154(b) by 154 days.

(21) Appl. No.: 17/411,077

(22) Filed: Aug. 25, 2021

(65) Prior Publication Data

US 2023/0014980 A1 Jan. 19, 2023

(30) Foreign Application Priority Data

Jul. 16, 2021 (CN) ..... 202121630426.7

(51) Int. Cl.
*B05B 1/16* (2006.01)
*B05B 1/18* (2006.01)

(52) U.S. Cl.
CPC ..... *B05B 1/1672* (2013.01); *B05B 1/1681* (2013.01); *B05B 1/18* (2013.01)

(58) Field of Classification Search
CPC ..... E03C 1/0404; E03C 1/04; E03C 1/023; E03C 2201/30; B05B 12/1418; B05B 15/62; B05B 12/002; B05B 1/1609; B05B 12/04
See application file for complete search history.

(56) References Cited

U.S. PATENT DOCUMENTS 10,232,386 B1 * 3/2019 Lu ..... F16K 11/0743

* cited by examiner

*Primary Examiner* — Qingzhang Zhou
*Assistant Examiner* — Joel Zhou

(57) ABSTRACT

A switching device for shower system includes a housing; a valve core main body, wherein the valve core main body includes a first valve core and a second valve core, a first end of the first valve core is provided with a plurality of water passing holes in different positions, and a second end of the first valve core is slidably connected to the second valve core; a push rod, wherein the push rod is located inside the valve core main body, and an end of the push rod is inserted into the second valve core; and a switching assembly, wherein a first end of the switching assembly is slidably connected to the housing and a second end of the switching assembly is connected to the second valve core, when the switching assembly is pressed, the push rod is pushed to switch the water passing holes in different positions.

9 Claims, 7 Drawing Sheets

SWITCHING DEVICE FOR SHOWER SYSTEM AND SHOWER SYSTEM INCLUDING SAME

CROSS-REFERENCE TO RELATED APPLICATIONS

This application is based upon and claims priority to Chinese Patent Application No. 202121630426.7, filed on Jul. 16, 2021, the entire content of which is incorporated herein by reference.

TECHNICAL FIELD

The present disclosure relates to a shower system, and in particular to a switching device for a shower system and a shower system including the same.

BACKGROUND

A hand shower that includes a hand piece for a user to hold is convenient in use while also having several drawbacks. For example, the hand shower usually has a compact structure with a small water outlet panel, which cannot satisfy the need of users of a large body figure. The fixed overhead shower usually has a relatively larger water outlet panel, but as it is fixed, flexibility is poor. To overcome the drawbacks of both of the hand shower and overhead shower, designer combined the two types of shower to create a combined shower system, which enables the user to use the overhead shower or the hand shower independently while increasing the spraying area.

However, the water passage switching of the combined shower is more complex. Generally, a three-way connector with a switching valve is used to connect the overhead shower, hand shower or water inlet pipeline. The three-way connector is usually assembled on a discharge tube of the overhead shower, a switching handle is provided on the three-way connector, and the water inlet pipeline is also provided with a switching valve. This kind of structure is complicated and not user friendly.

SUMMARY

The present disclosure provides a switching device for a shower system and a shower system including same, which can effectively solve the above-mentioned problems.

The present disclosure provides a switching device for a shower system, including:

a housing;

a valve core main body, wherein the valve core main body includes a first valve core and a second valve core, a first end of the first valve core is provided with a plurality of water passing holes in different positions, and a second end of the first valve core is slidably connected to the second valve core;

a push rod, wherein the push rod is located inside the valve core main body, and an end of the push rod is inserted into the second valve core; and a switching assembly, wherein a first end of the switching assembly is slidably connected to the housing and a second end of the switching assembly is connected to the second valve core, when the switching assembly is pressed, the push rod is pushed to switch the water passing holes in different positions.

As a further improvement, the water passing holes include a first water passing hole, a second water passing hole and a third water passing hole; wherein, the first water passing hole is located at a front end surface of the first valve core, the second water passing hole and the third water passing hole are provided on a side surface of the first valve core.

As a further improvement, the push rod includes a first push rod and a second push rod, wherein a rear end of the first push rod abuts against a front end of the second push rod.

As a further improvement, the first valve core is internally provided with an annular support groove; an end of the first push rod is provided with an annular support member extending outward from the push rod; wherein a spring is provided inside the support groove, a first end of the spring abuts against a rear end surface of the support groove, and a second end of the spring extends out of a front end surface of the support groove to abut against an end surface of the annular support member.

As a further improvement, an inner sidewall of the first valve core is provided with a first sliding member, an outer sidewall of the second valve core is provided with a second sliding member; wherein, the second sliding member is configured to slide along the first sliding member.

As a further improvement, a third sliding member is provided around the second push rod, when the second sliding member pushes the third sliding member to move back and forth, the third sliding member reciprocates between the bottom and the top of the first sliding member.

As a further improvement, an upper end of the housing is provided with a first connector, and a lower end of the housing is provided with a second connector. The first connector is provided with a water inlet port and a water outlet port, the water inlet port communicates with the second water passing hole, and the water outlet port communicates with the third water passing hole.

As a further improvement, the housing is internally provided with a plugging element; the water inlet port, the second water passing hole, the first water passing hole, the plugging element, and the second connector are arranged successively to form a first water passage; the water inlet port, the second water hole, the third water hole, and the water outlet port are arranged successively to form a second water passage.

The present disclosure also provides a shower system, including a discharge tube, a hand shower, an overhead shower, and the switching assembly as described above. The discharge tube includes a first shower tube and a second shower tube. The second shower tube includes an inner tube and an outer tube, the inner tube communicates with the first water passage, and the outer tube communicates with the second water passage.

As a further improvement, an adapter is connected between the first shower tube and the second shower tube.

The present disclosure has the following advantages.

First, the switching device of the present disclosure includes a housing, a valve core main body, a push rod, and a switching assembly, the valve core main body is installed inside the housing, the push rod is located inside the valve core main body, and the switching assembly is slidably connected to the front end of the housing facing the user. The switching assembly is connected with the valve core main body, and the valve core main body is provided with multiple water passing holes at different positions. When in use, the push rod is pushed by pressing the switching assembly, and the push rod moves to switch the water passing holes at different positions, thereby switching the water passage. By doing so, the switching of the hand shower and the overhead shower is realized. The valve core main body of the present disclosure has a simple structure, only a press-type switching assembly is required to match with the valve core main body inside the housing and the push rod inside the valve core main body. The press-type switching assembly is convenient, sensitive to a pressing action, and user friendly. The above-mentioned configuration of the present disclosure may effectively avoid the drawbacks of the traditional configuration in which a three-way connector is provided with a switch handle while a water inlet tube is also provided with a switch valve.

Second, in the present disclosure, the second shower tube is provided with an inner tube and an outer tube. The inner tube communicates with the hand shower when corresponding water passing hole on the valve core main body is switched on. Similarly, the outer tube also communicates with the overhead shower. The configuration of the inner tube and the outer tube is compact, space saving, convenient to realize the switching of different water passages.

BRIEF DESCRIPTION OF THE DRAWINGS

In order to clearly explain the embodiments of the present disclosure, the drawings that would be used in describing the embodiments will briefly introduced below. It should be understood that the drawings illustrated below merely includes some of the embodiments of the present disclosure and should not be considered as limiting the scope of the present disclosure. For those of ordinary skill in the art, other drawings may be derived based on these drawings without creative effort.

Figure 1:
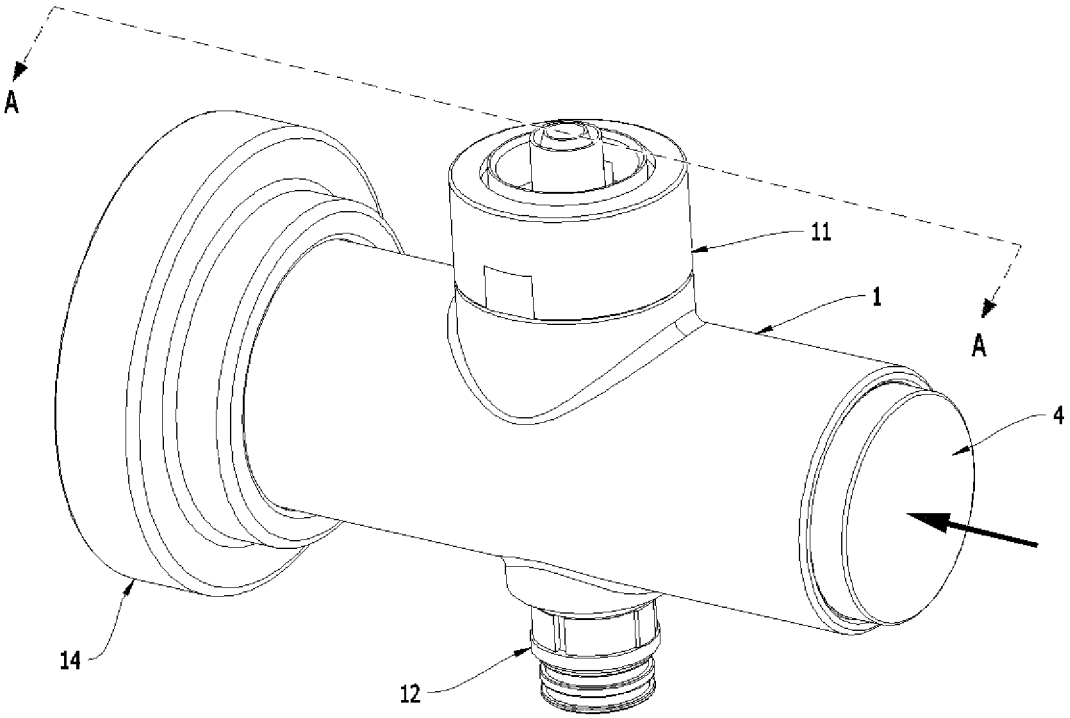
FIG. 1 is a structural schematic diagram of a switching device for a shower system according to an embodiment of the present disclosure.

The reference numerals in the drawings are listed below:

1. housing;
11. first connector; 111. water inlet port; 112. water outlet port;
12. second connector;
13. plugging element;
14. mounting seat;
2. valve core main body;
21. first valve core; 21*a*. front end of the valve core; 21*b*. rear end of the valve core;
211. water passing hole; 2111. first water passing hole; 2112. second water passing hole; 2113. third water passing hole;
212. support groove;
213. first sliding member;
213*a*. first sliding groove; 213*b*. second sliding groove; 213*c*. support surface; 213*d*. side stopping member;
22. second valve core; 221. second sliding member;
3. push rod;
31. first push rod; 311. annular support member;
32. second push rod; 321. third sliding member;
4. switching assembly; 41. first switching element; 42. second switching element;
5. spring;
6. first water passage;
7. second water passage;
8. discharge tube;
81. first shower tube;
82. second shower tube; 821. inner tube; 822. outer tube;
9. hand shower;
10. overhead shower;
20. adapter;
201. water inlet pipeline; 202. separating board; 203. fourth water passing hole;
204. fifth water passing hole.

DETAILED DESCRIPTION OF THE EMBODIMENTS

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure.

In the description of the present disclosure, the terms "first", "second" are used only for descriptive purposes and cannot be understood as indicating or implying relative importance or implying the number of indicated technical features. Thus, a characteristic that is referred to by "first" and "second" may include, expressly or implicitly, one or more of the characteristics. Also, it should be noted that the terms of "up", "down", "inside/inner", "outside/outer", "front end", "rear end", "two ends", "one end", "another end", "one side", "another side" for indicating the location or orientation are based on the location or orientation shown in the drawings for the sake of simplifying the description of the present disclosure, rather than indicate or imply that the indicated device or component must have specific location or orientation, or be constructed and operated by specific orientation. These terms should not be understood as limits to the present disclosure.

Referring to FIGS. 1-4, embodiments of the present disclosure provide a convenient switching device for a shower system, which includes a housing 1, a valve core main body 2, a push rod 3, and a switching assembly 4. The housing 1 in this embodiment has a four-way structure, and two water pipe connectors are respectively provided at the upper and lower ends of the housing 1. In the present embodiment, the two water pipe connectors are first connector 11 and second connector 12. The switching assembly 4 is provided at the front end of the housing 1 and faces the user. The switching assembly 4 is used as the water passage switching button for the switching device of the present embodiment. A mounting seat 14 is provided at the rear end of the housing 1 for mounting and fixing the switching device on the wall. By pressing the switching assembly 4, the position of the water outlet port on the valve core main body 2 in the housing 1 is changed, thereby switching the water passage in the valve core main body 2 and changing the water flow direction. The switching device of the present disclosure is simple and convenient to use.

Figure 2:
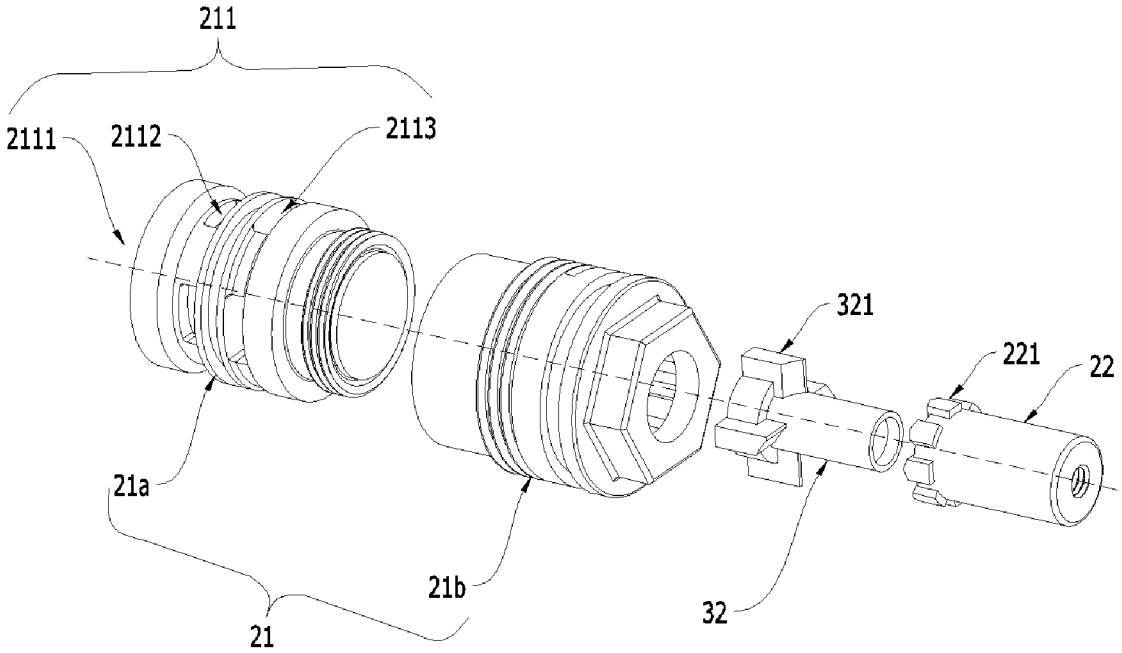
FIG. 2 is an exploded view of a valve core main body according to an embodiment of the present disclosure.

Further, as shown in FIG. 2, the valve core main body 2 in the present embodiment includes a first valve core 21 and a second valve core 22. A first end of the first valve core 21 is provided with a plurality of water passing holes 211, and a second end of the first valve core 21 is slidably connected to the second valve core 22. The first valve core 21 in the present embodiment further includes a valve core front end 21*a* and a valve core rear end 21*b*. The valve core front end 21*a* and the valve core rear end 21*b* are connected by threads and formed into a whole. An outer surface of the valve core rear end 21*b* is provided with threads which are connected with the threads provided on the inner sidewall of the housing 1 so as to fix the valve core main body 2 inside the housing 1.

The water passing holes 211 in the present embodiment are all provided on the valve core front end 21*a*. The water passing holes 211 include a first water passing hole 2111, a second water passing hole 2112 and a third water passing hole 2113. The first water passing hole 2111 is provided on the front end surface of the valve core front end 21*a*, and the second water passing hole 2112 is immediately provided on the outer side surface of the valve core front end 21*a*. The second water passing hole 2112 further includes a plurality of holes evenly distributed around the outer surface of the valve core front end 21*a*. Meanwhile, a third water passage hole 2113 is provided in parallel with the second water passing hole 2112, and the third water passage hole 2113 also further includes a plurality of holes evenly distributed around the outer surface of the valve core front end 21*a*.

Figure 4:
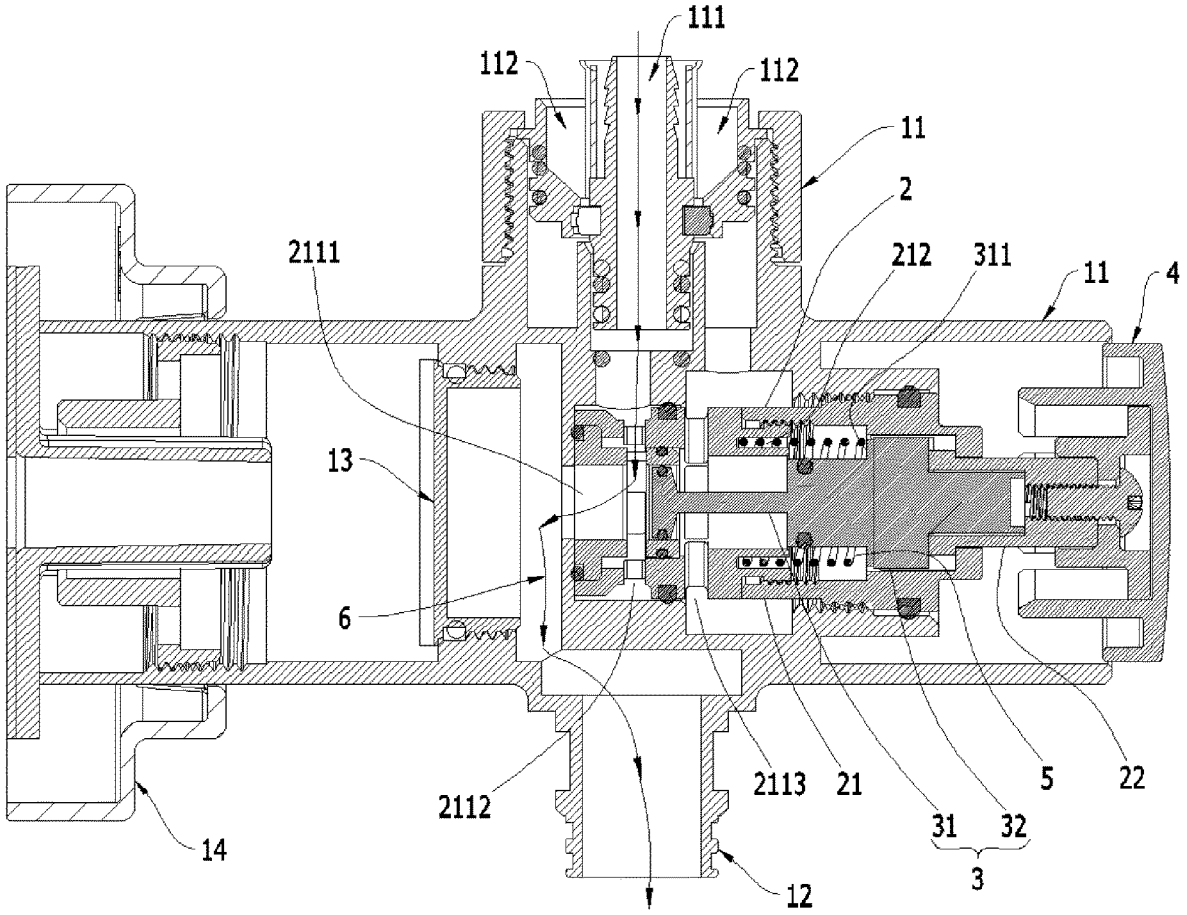
FIG. 4 is a sectional view taken along A-A shown in FIG. 1, which shows a first water passage.
Figure 5:
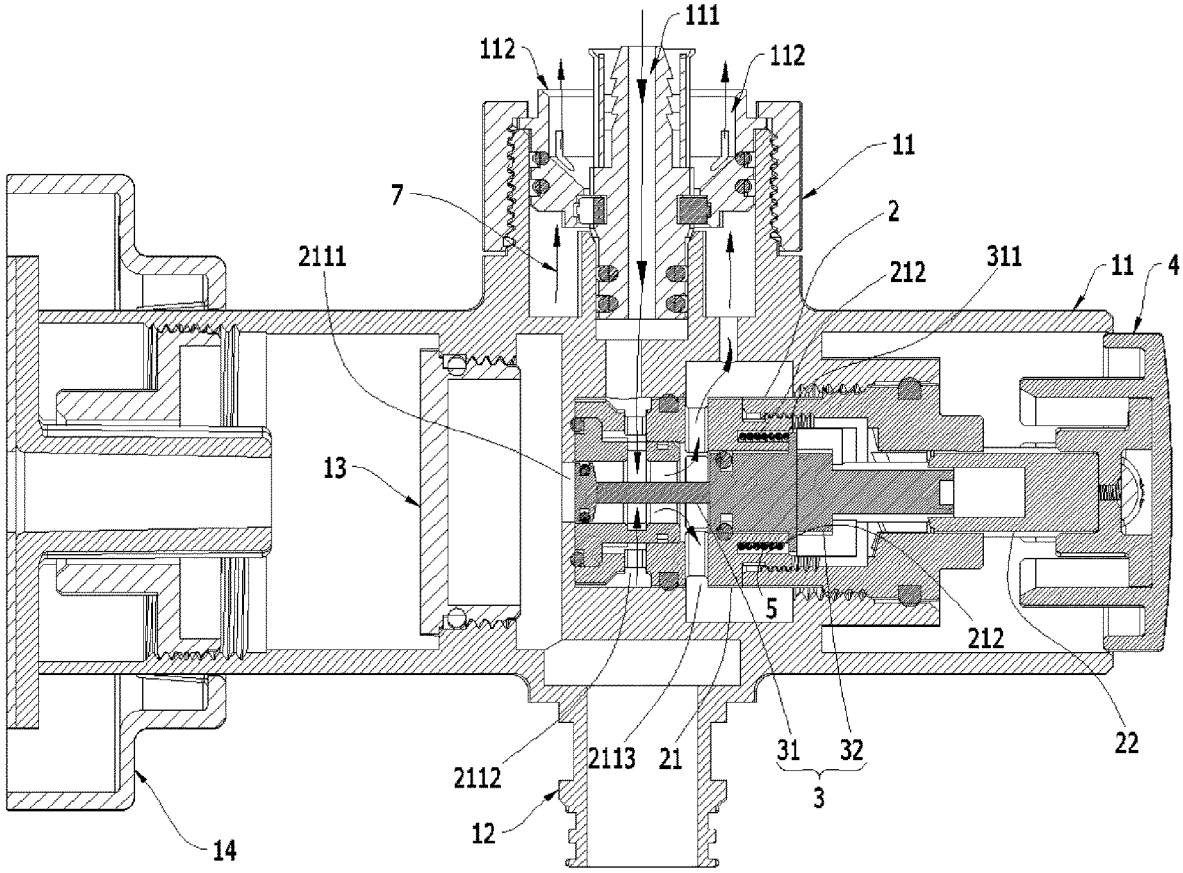
FIG. 5 is a sectional view taken along A-A shown in FIG. 1, which shows a second water passage.

Furthermore, as shown in FIGS. 4 and 5, the push rod 3 is located inside the valve core main body 2. The push rod 3 includes a first push rod 31 and a second push rod 32. A first end of the second push rod 32 abuts against the rear end of the first push rod 31, and a second end of the second push rod 32 is inserted into the second valve core 22. The second end of the second push rod 32 in this embodiment may slide back and forth along the inner wall of the second valve core 22. In the present embodiment, the diameter of the middle section of the first push rod 31 is smaller than that of the two ends, which allows water to flow through the middle section of the first push rod 31 and then flow out from the corresponding water passing holes. A sealing ring is provided between a side surface of the front end of the first push rod 31 and the inner wall of the valve core main body 2 for sealing purposes.

Figure 6:
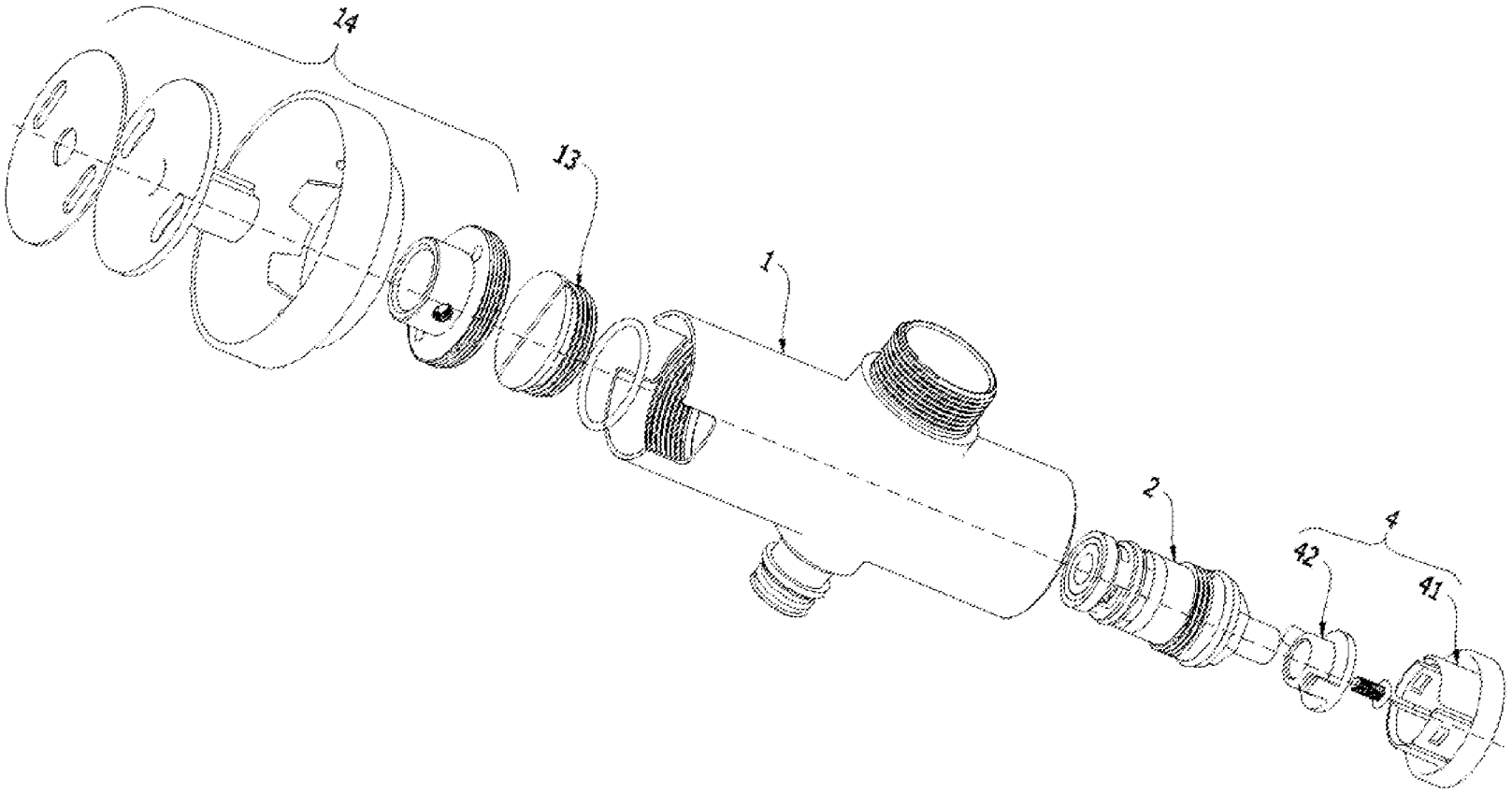
FIG. 6 is an exploded view of a switching device for the shower system according to an embodiment of the present disclosure.

Further, as shown in FIG. 6, a first end of the switching assembly 4 is slidably connected inside the housing 1, and a second end of the switching assembly 4 is connected to the second valve core 22. The switching assembly 4 includes a first switching element 41 and a second switching element 42. The first switching element 41 is connected to the second switching element 42 through engaging elements correspondingly provided on the side surfaces of the first switching element 41 and second switching element 42. The end portion of the second valve core 22 is inserted into the second switching element 42. The end portion of the second valve core 22 is provided with a mounting hole for bolt, and the second valve core 22 and the second switching element 42 are connected by bolt. In the present embodiment, the first switching element 41 and the second switching element 42 are connected to each other in a snap-fit manner which is simple in structure and convenient in assembling. Meanwhile, connecting the second valve core 22 with the second switching element 42 by bolt is convenient for assembling and disassembling.

Further, the first valve core 21 is internally provided with an annular support groove 212. An end of the first push rod 31 is provided with an annular support member 311 extending outward from the push rod. Specifically, in the present embodiment, the support groove 212 is provided at the valve core front end 21*a*, and a spring 5 is provided in the support groove 212. A first end of the spring 5 abuts against a rear end surface of the support groove 212, and a second end of the spring 5 extends out of a front end surface of the support groove 212 to abut against an end surface of the annular support member 311. When the switching assembly 4 is pressed, the second push rod 32 is pushed and the first push rod 31 is pushed by the second push rod 32, so that the annular support member 311 at the end of the first push rod 31 compresses the spring 5.

Figure 3:
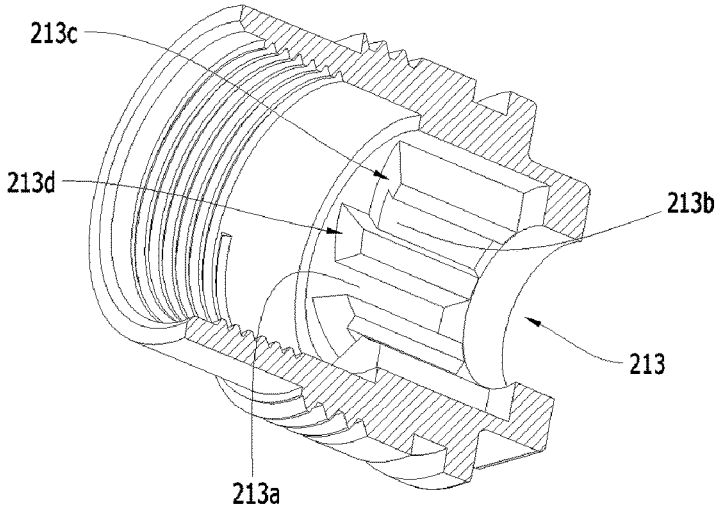
FIG. 3 is a sectional view of a rear end of a valve according to an embodiment of the present disclosure.

Further, as shown in FIGS. 2 and 3, in the present embodiment, an inner sidewall of the first valve core 21 is provided with a first sliding member 213, and an outer sidewall of the second valve core 22 is provided with a second sliding member 221. The second sliding member 221 slides along the first sliding member 213. In addition, a third sliding member 321 is provided around the second push rod 32. When the second sliding member 221 moves back and forth to push the third sliding member 321, the third sliding member 321 may slide back and forth from the bottom to the top of the first sliding member 213.

Specifically, the first sliding member 213 is provided on the inner wall of the valve core rear end 21*b*, the first sliding member 213 includes a plurality of first sliding grooves 213*a* and second sliding grooves 213*b* evenly arranged in an alternate manner, and an upper end of the second sliding groove 213*b* has a supporting surface 213*c*. The supporting surface 213*c* is an inclined surface, and a side of the supporting surface 213*c* is provided with a side blocking element 213*d* higher than the supporting surface 213*c*, and a top end surface of the side blocking element 213*b* is also an inclined surface. In the present embodiment, the second sliding members 221 on the outer wall of the second valve core 22 are respectively located in the first sliding groove 213*a* and the second sliding groove 213*b*. The third sliding member 321 on the second push rod 32 merely moves in the first sliding groove 213*a*. In the present embodiment, an end surface of the second sliding member 221 is consist of two inclined surfaces with two sides meet at the top. An end surface of the third sliding member 321 is an inclined surface, which is in contact with the inclined surface at the top of the second sliding member 221.

In an initial position, the third sliding member 321 on the second push rod 32 is located at the bottom of the first sliding groove 213*a*, and the front end of the first push rod 31 is located between the second water passing hole 2112 and the third water passing hole 2113, the water flows in from the second water passing hole 2112 and flows out from the first water passing hole 2111. In this situation, the water is unable to flow through the third water passing hole 2113. The second valve core 22 is pushed by pressing the switching assembly 4, and the second sliding member 221 on the outer wall of the second valve core 22 pushes the third sliding member 321 on the second push rod 32 to make the third sliding member 321 move from the bottom of the first sliding groove 213*a* to the top. Meanwhile, the second push rod 32 rotates and slides to the supporting surface 213*c* on the second sliding groove 213*b*, and the side blocking portion 213*d* supports the third sliding member 321. At this time, the spring 5 is compressed, and the front end of the first push rod 31 is located between the first water passing hole 2111 and the second water passing hole 2112. After the water flows in from the second water passing hole 2112, the water is unable to pass through the first water passing hole 2111, and then the water turns its way to flow out from the third water passing hole 2113. When the switching assembly 4 is pressed again to push the second valve core 22, the second sliding member 221 on the outer wall of the second valve core 22 pushes the third sliding member 321 on the second push rod 32. Under the elastic force of the spring 5, the third sliding member 321 rotates and slides from the top of the side blocking element 213*c* to the bottom of the first sliding groove 213*a* to finish a complete waterway switching action. In the present embodiment, the push rod 3 is pushed by pressing the switching assembly 4, and the water passing holes 211 at different positions are switched by moving the push rod 3 to achieve the effect of switching between different water passages, thereby realizing the switch of the hand shower and the overhead shower.

Further, as shown in FIGS. 4 and 5, an upper end of the housing 1 is provided with a first connector 11, and a lower end of the housing 1 is provided with a second connector 12. The first connector 11 is provided with a water inlet port 111 and a water outlet port 112 which are independent to each other. The water inlet port 111 communicates with the second water passing hole 2112.

Further, the housing 1 is internally provided with a plugging element 13. The plugging element 13 is internally connected to the housing 1 by threads, and a sealing ring is provided between the plugging element 13 and the inner wall of the housing 1 for preventing water leakage. At the same time, a baffle is provided in front of the plugging element 13, and the baffle is integrally formed with the housing 1. The baffle is used to support and limit the position of the valve core main body 2, and the baffle is provided with an opening at the center to communicate with the first water passing hole 2111. In the present embodiment, the water inlet port 111, the second water passing hole 2112, the first water passing hole 2111, the plugging element 13, and the second connector 12 are arranged successively to form the first water passage 6. The water inlet port 111, the second water passing hole 2112, the third water passing hole 2113, and the water outlet port 112 are arranged successively to form the second water passage 7.

Figure 7:
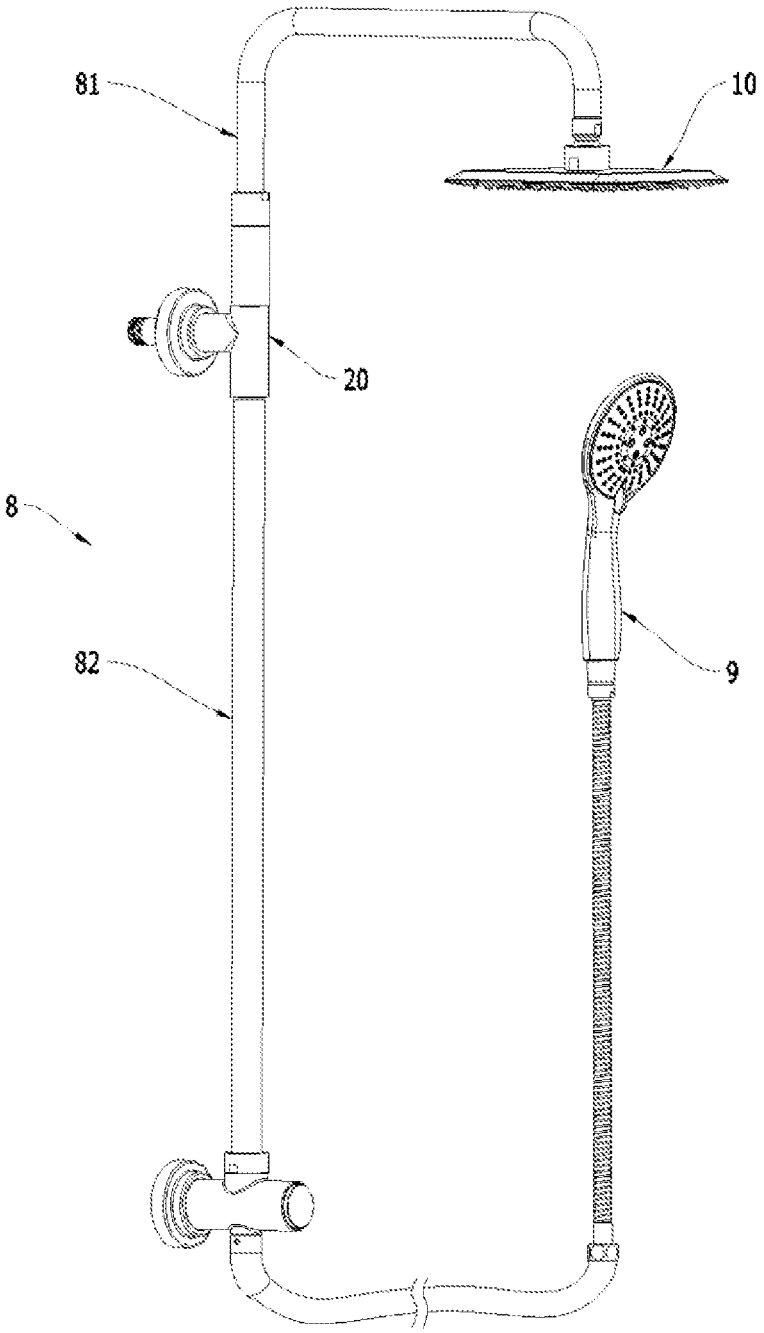
FIG. 7 is a structural schematic diagram of the shower system according to an embodiment of the present disclosure.
Figure 8:
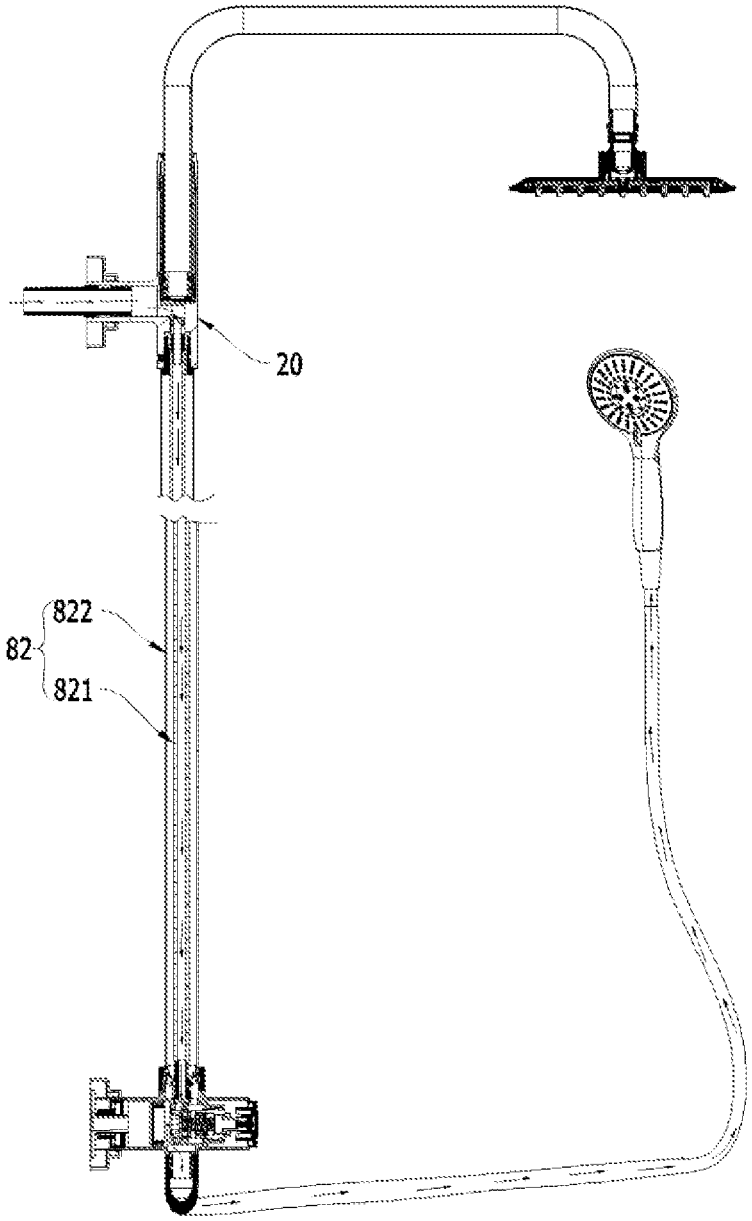
FIG. 8 is a sectional view of the shower system according to an embodiment of the present disclosure.

As shown in FIGS. 7 and 8, the present embodiment provides a shower system, which includes a discharge tube 8, a hand shower 9, an overhead shower 10, and the switching device described above. The discharge tube 8 includes a first shower tube 81 and a second shower tube 82. The second shower tube 82 includes an inner tube 821 and an outer tube 822. The inner tube 821 communicates with the first water passage 6, and the outer tube 822 communicates with the second water passage 7. An adapter 20 is connected between the first shower tube 81 and the second shower tube 82.

Specifically, the first shower tube 81 is connected between an upper end of the adapter 20 and the overhead shower 10. The second shower tube 82 is connected between the lower end of the adapter 20 and the first connector 11 of the switching device in the present embodiment. In the present embodiment, the first shower tube 81 is a single-layer pipe, and the second shower tube 82 includes two layers, i.e. inner tube 821 and outer tube 822, which enables the switching of the above-mentioned water passages. The inner tube 822 communicates with the water inlet port 111 at the upper end of the housing 1. The outer tube 822 communicates with the water outlet port 112 surrounding the water inlet port 111.

Figure 9:
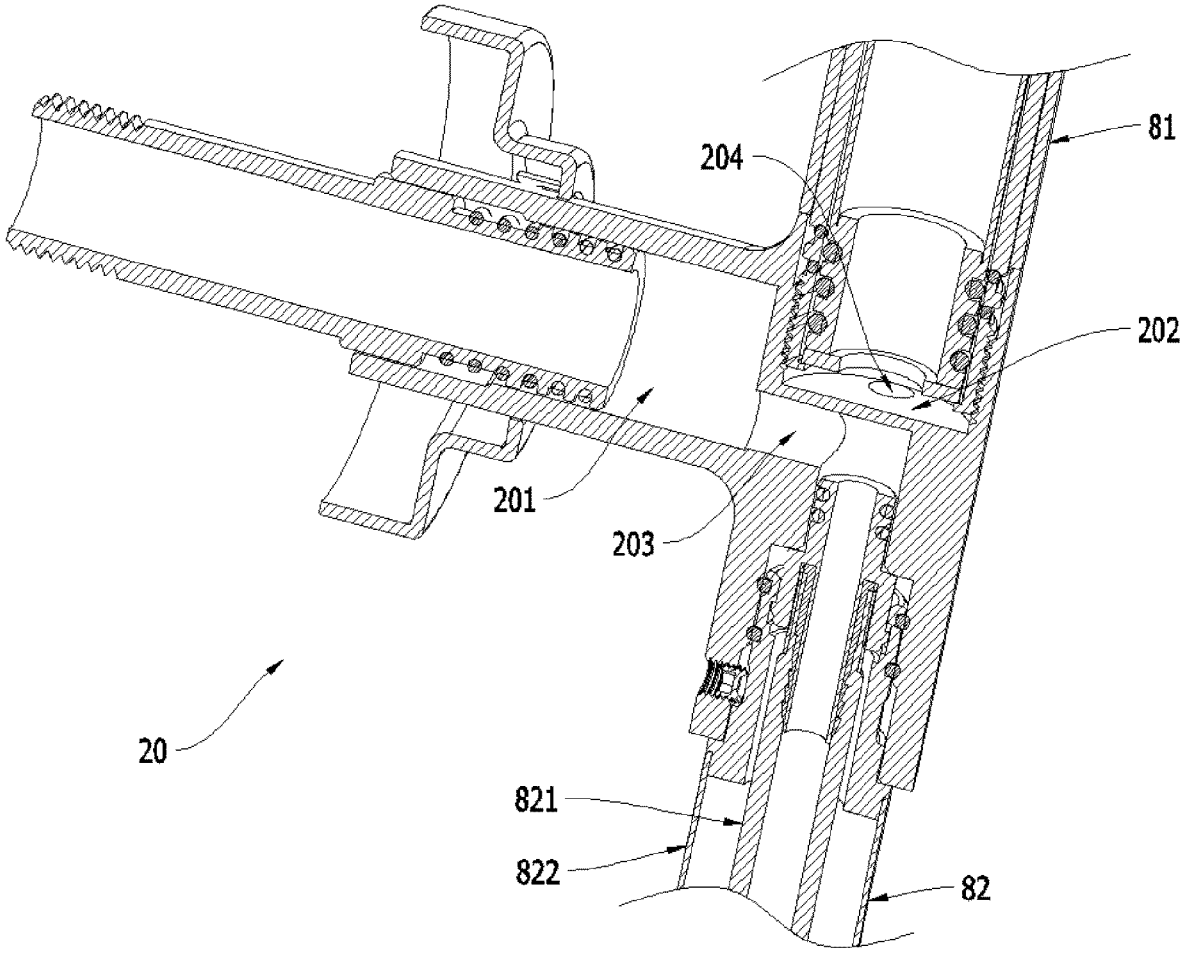
FIG. 9 is a sectional view of an adapter according to an embodiment of the present disclosure.

Furthermore, as shown in FIG. 9, in the present embodiment, a water inlet pipe 201 is connected to the side port of the adapter 20. A partition plate 202 is provided in the adapter 20. A fourth water passing hole 203 is provided below the partition plate 202 for communicating the inner tube 821 and the water inlet pipe 201 to supply water for the hand shower 9. Fifth water passing holes 204 are provided near the edge of the partition plate 202. The fifth water passing holes 204 communicate the outer tube 822 and the first shower tube 81 to supply water for the overhead shower 10.

The above descriptions merely cover the preferred embodiments of the present disclosure which should not be considered as limit to the present disclosure. For those of ordinary skill in the art, the present disclosure may have various modifications and changes. Any modification, equivalent substitution, improvement made by a skilled person without departing from the spirit and principle of the present disclosure fall within the scope of the present disclosure.

What is claimed is:

1. A switching device for a shower system, comprising:

a housing;

a valve core main body, wherein the valve core main body comprises a first valve core and a second valve core, a first end of the first valve core is provided with a plurality of water passing holes in different positions, and a second end of the first valve core is slidably connected to the second valve core, the water passing holes comprise a first water passing hole, a plurality of second water passing holes and a plurality of third water passing holes; the first water passing hole is located at a front end surface of the first valve core, the second water passing holes are evenly distributed around an outer surface of a valve core front end of the first valve core and the third water passing holes are evenly distributed around the outer surface of the valve core front end of the first valve core behind the second water passing holes, the first water passing hole and the second water passing holes form a part of a first water passage, the first water passing hole and the third water passing holes form a part of a second water passage;

a push rod, wherein the push rod is located inside the valve core main body, and an end of the push rod is inserted into the second valve core; and a switch button unit, wherein a first end of the switch button unit is slidably connected to the housing and a second end of the switch button unit is connected to the second valve core, and when the switch button unit is pressed, the push rod can switch on one of the first water passage and the second water passage and close the other one of the first water passage and the second water passage.

2. The switching device for the shower system according to claim 1, wherein the push rod comprises a first push rod and a second push rod, a first end of the second push rod abuts against a rear end of the first push rod and a second end of the second push rod is inserted into the second valve core;

in an initial position, a front end of the first push rod is located between the second water passing holes and the third water passing holes.

3. The switching device for the shower system according to claim 2, wherein the first valve core is internally provided with an annular support groove; an end of the first push rod is provided with an annular support member extending outward from the push rod; a spring is provided inside the support groove, a first end of the spring abuts against a rear end surface of the support groove, and a second end of the spring extends out of a front end surface of the support groove to abut against an end surface of the annular support member.

4. The switching device for the shower system according to claim 2, wherein first sliding ribs are arranged on an inner sidewall of the first valve core, the first sliding ribs form a plurality of first sliding grooves and second sliding grooves that are evenly arranged in an alternate manner, an outer sidewall of the second valve core is provided with second sliding ribs; the second sliding ribs are configured to slide along the first sliding grooves and second sliding grooves.

5. The switching device for the shower system according to claim 4, wherein third sliding ribs are provided around an outer sidewall of the second push rod, the third sliding ribs are configured to move along the first sliding grooves, when the second sliding ribs pushes the third sliding ribs to move back and forth, the third sliding protrusion reciprocates between a bottom and a top of the first sliding ribs.

6. The switching device for the shower system according to claim 1, wherein an upper end of the housing is provided with a first connector, and a lower end of the housing is provided with a second connector, the first connector is provided with a water inlet port and a water outlet port, the water inlet port communicates with the second water passing hole, and the water outlet port communicates with the third water passing hole.

7. The switching device for the shower system according to claim 6, wherein the housing is internally provided with a plug; the water inlet port, the second water passing hole, the first water passing hole, the plug, and the second connector are arranged successively to form the first water passage; the water inlet port, the second water hole, the third water hole, and the water outlet port are arranged successively to form the second water passage.

8. A shower system, comprising: a discharge tube, a hand shower, an overhead shower, and a switching assembly; wherein, the switching device comprises:

a housing;

a valve core main body, wherein the valve core main body comprises a first valve core and a second valve core, a first end of the first valve core is provided with a plurality of water passing holes in different positions, and a second end of the first valve core is slidably connected to the second valve core, the water passing holes comprise a first water passing hole, a plurality of second water passing holes and a plurality of third water passing holes; the first water passing hole is located at a front end surface of the first valve core, the second water passing holes are evenly distributed around an outer surface of a valve core front end of the first valve core and the third water passing holes are evenly distributed around the outer surface of the valve core front end of the first valve core behind the second water passing holes, the first water passing hole and the second water passing holes form a part of a first water passage, the first water passing hole and the third water passing holes form a part of a second water passage;

a push rod, wherein the push rod is located inside the valve core main body, and an end of the push rod is inserted into the second valve core; and a switch button unit, wherein a first end of the switch button unit is slidably connected to the housing and a second end of the switch button unit is connected to the second valve core, when the switch button unit is pressed, the push rod can switch on one of the first water passage and the second water passage and close the other one of the first water passage and the second water passage;

the discharge tube comprises a first shower tube and a second shower tube; the second shower tube comprises an inner tube and an outer tube, the inner tube communicates with the first water passage, and the outer tube communicates with the second water passage.

9. The shower system according to claim 8, wherein an adapter is connected between the first shower tube and the second shower tube.

* * * * *